United States Patent [19]

Johnson et al.

[11] Patent Number: 4,867,630

[45] Date of Patent: Sep. 19, 1989

[54] SAFETY CATCH FOR CONTAINER LIFTING HOOKS

[76] Inventors: Cleophas E. Johnson, 18514 Veach, Detroit, Mich. 48234; Lawrence M. Finazzo, 22908 Doremus, St. Clair Shores, Mich. 48080

[21] Appl. No.: 194,511

[22] Filed: May 16, 1988

[51] Int. Cl.[4] ..... B65F 3/02

[52] U.S. Cl. ..... 414/409; 294/68.2; 414/408; 414/421; 414/422

[58] Field of Search ..... 414/408, 409, 407, 406, 414/403, 404, 419, 420, 421, 422, 423, 424, 425; 294/68.1, 68.2, 68.26, 68.27, 82.17, 82.19, 82.2, 82.22

[56] References Cited

U.S. PATENT DOCUMENTS

| | | | |
|---|---|---|---|
| 3,040,919 | 6/1962 | Nolan | 414/406 X |
| 3,142,397 | 7/1964 | Felts | 414/406 |
| 3,856,164 | 12/1974 | Torvund | 414/422 |
| 3,858,927 | 1/1975 | Sutton | 294/68.26 |
| 3,910,434 | 10/1975 | Ebeling et al. | 414/408 |
| 3,931,901 | 1/1976 | Jones | 414/406 |

FOREIGN PATENT DOCUMENTS

| | | | |
|---|---|---|---|
| 622499 | 6/1961 | Canada | 414/422 |
| 2419982 | 10/1975 | Fed. Rep. of Germany | 414/422 |
| 3414825 | 11/1985 | Fed. Rep. of Germany | 294/68.2 |
| 1049649 | 11/1966 | United Kingdom | 414/408 |

*Primary Examiner*—Frank E. Werner
*Attorney, Agent, or Firm*—John R. Benefiel

[57] ABSTRACT

A safety catch is disclosed for reducing the incidence of accidental dislodgement of a pickup bar mating with a container lifting hook, the safety catch including a pivoted safety catch member mounted into and restricting the hook opening by contact with the lifting bar moving in a direction out of the lifting hook. The safety catch in the restricting position restrains the movement of the container pickup bar from the inside to prevent the bar from escaping and allowing the container to fall. However, the safety catch is moved aside to an unrestricting position when the bar contacts the same from the outside, incidental to being moved into engagement with the lifting hook.

4 Claims, 2 Drawing Sheets

SAFETY CATCH FOR CONTAINER LIFTING HOOKS

BACKGROUND DISCUSSION

This invention concerns lifting hooks and more particularly lifting hooks for rubbish containers which are engaged by a powered pickup bar to be hoisted and inverted to dump the contents into a collection truck.

Trash collection in many large cities is now highly mechanized to reduce the labor costs and improve the efficiency of the process. Such mechanization involves a powered lifting of the container by a lifting device controlled from within the collection truck by the driver. The lifting device has included pairs of lifting hooks fixed on either end of the containers engaged by a pickup bar as the device is actuated to move the bars towards the hooks and upwardly, with the container then hoisted and partially inverted to dump its contents into the truck. The driver does not dismount from the truck so that a single worker can quickly handle each pickup.

It sometimes happens that in the jostling that occurs in the container's movement away from the partially inverted position, the hooks unseat from the pickup bar and the container is dropped from its elevated position, presenting a hazard and damaging the container itself.

While it is well known to utilize locking accessories on lifting hooks, these have therefor required manual manipulation of the locking elements in securing and releasing the device. Inclusion of these devices would require dismounting by the driver, so that efficiency of the operation would be greatly reduced, or the driver would simply neglect to use the device.

Any such safety device should not make engagement of the pickup bars with the hook more difficult so as to make the operation more difficult or time consuming.

Also, any such devices must be very rugged and dependable to withstand the rough handling inherent in these operations.

Accordingly, it is an object of the present invention to provide a catch device for reducing the incidence of dislodgement of pickup bars from lifting hooks for containers which does not necessitate any separate activating steps, and which is rugged and dependable to operate reliably in this environment.

SUMMARY OF THE INVENTION

This and other objects which will become apparent upon a reading of the following specification and claims are accomplished by a catch member pivotally mounted on the lifting hook. The catch member has an inner contour shape so as to be coextensive with the interior of the lifting hook, in an open position, with the hook opening unrestricted. The geometry of the catch member and the location of the pivotal mounting are such that the inner contour moves across the hook opening to partially restrict the same as the catch member pivots away from its open position. An actuator piece is integral with the catch member and extends across the hook opening when the catch member is in the open position; causing the catch member to be moved to a restricting position upon any movement of a seated pickup bar towards the hook opening.

The catch member is pushed away to an opening position when contacted by the pickup bar from the outside, so that the engagement step is not made more difficult or time consuming, but resists such movement when contacted from the inside to present an impeding restriction on the movement of the pickup bar, to reduce the chances of unintended dislodgement of the container.

DESCRIPTION OF THE DRAWING FIGURES

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
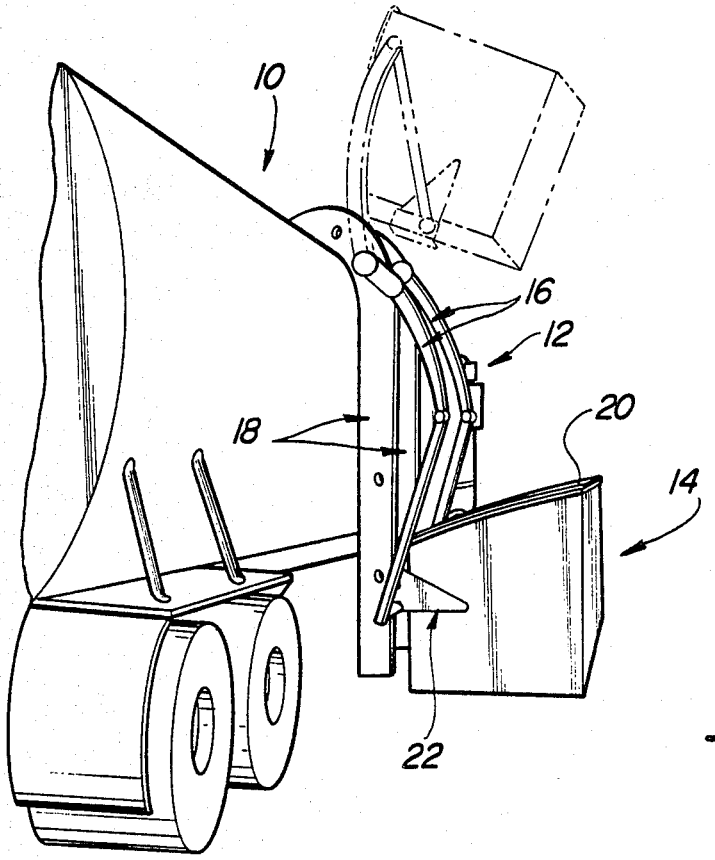
FIG. 1 is a fragmentary rear perspective view of a collection truck and container, depicting the pickup operation in phantom.
Figure 2:
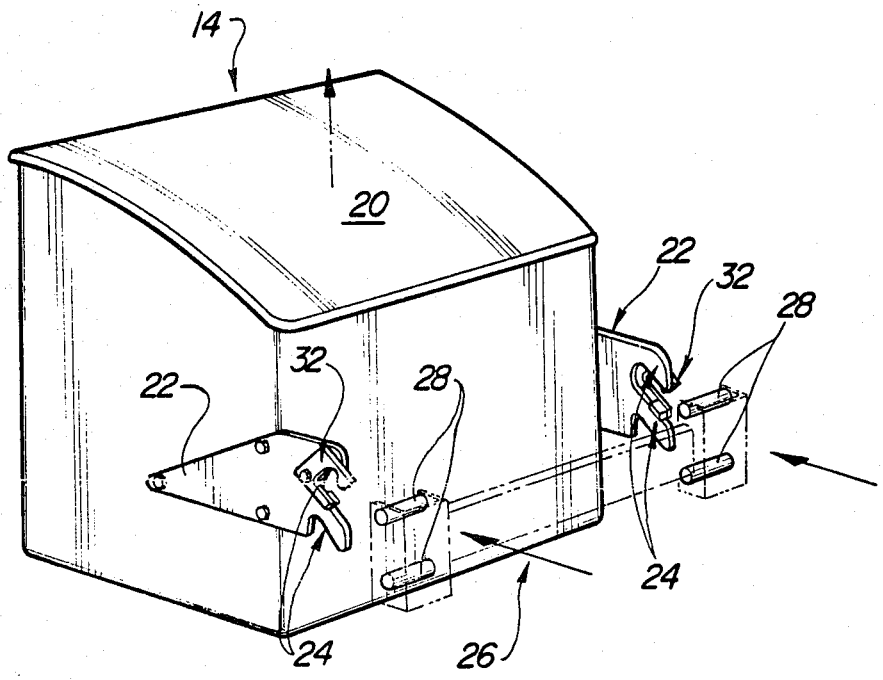
FIG. 2 is a perspective view of a container and adjacent pickup bar.
Figure 3:
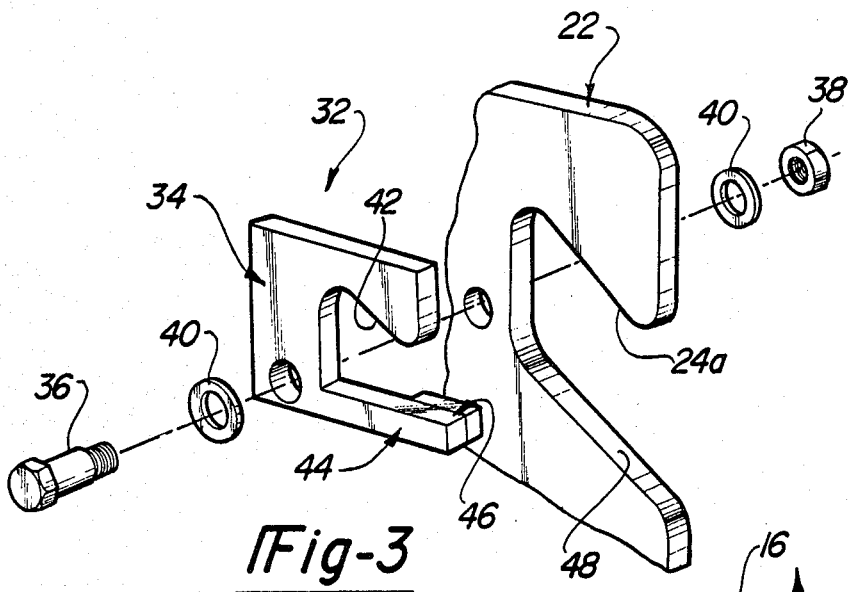
FIG. 3 is an exploded perspective view of a container lifting hook and safety catch mechanism according to the present invention.

Referring to the Drawings, and particularly FIG. 1, a collection truck 10 is shown, equipped with a lifting mechanism 12, mounted on one side of the truck 10. The lifting mechanism 12 is adapted to engage a container 14 and hoist the same to a partially inverted position to dump the contents into an opening in the top of the truck (not shown).

The lifting mechanism is of a conventional design and the details are not here described, but generally operates by movement of linkages 16 in tracks 18 to carry the container 14 up and over the side of the truck 10.

The container 14 is provided with a hinged lid 20 which opens when the container is inverted to allow dumping of the contents.

Figure 4:
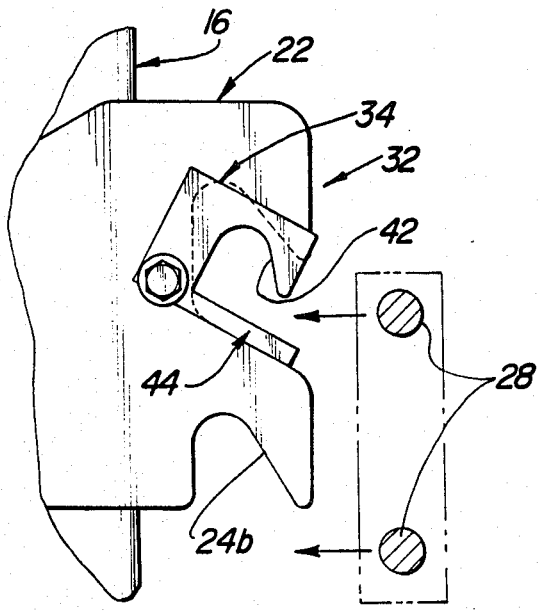
FIG. 4 is a side elevational view of a container lifting hook and safety catch mechanism with the pickup bar shown in position to move to engage the lifting hooks, the catch member in the restricting position.
Figure 5:
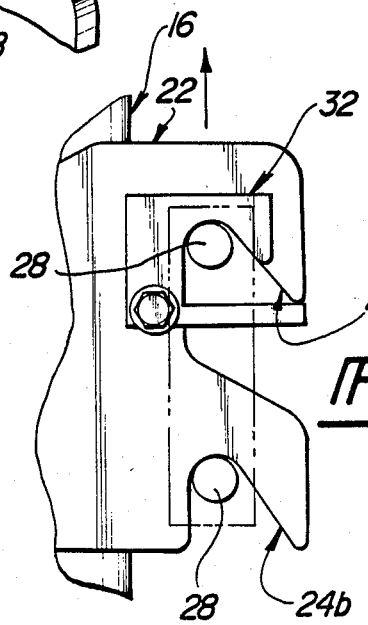
FIG. 5 is a side elevational view of the lifting hooks and safety catch, showing the pickup bar in engagement and the safety catch member in the open or unrestricted position.

The container 14 is provided with lifting features comprised of plates 22 bolted on either side of the container 14, each formed with vertically spaced pairs of shaped cutouts forming downwardly facing lifting hooks 24*a*, 24*b*. The lifting mechanism 12 includes a pickup bar 26 including spaced pairs of rods 28 each configured to be received in a respective set of upper and lower lifting hooks 24*a*, 24*b*. The lifting mechanism 12 is operated to swing the linkages 16 so as to move the rods 26 beneath the lifting hooks 24*a*, 24*b* so that when subsequently raised, the rods 28 are engaged therewith to enable lifting of the containers 14, as shown in FIGS. 4 and 5.

Figure 6:
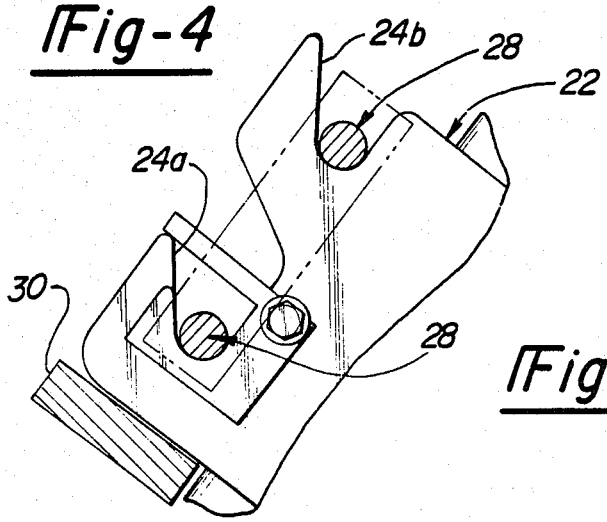
FIG. 6 is a side elevational view of the lifting hooks shown against a stop in the partially inverted dumping position of the container.

The lifting mechanism 12 also includes a stop plate 30 (FIG. 6) against which the plates 22 are driven when the container 14 is inverted to prevent the container 14 from simply falling off the rods 28 as the lifting hooks 24*a*, 24*b* are also inverted.

According to the present invention, safety catch devices 32 are associated with the upper lifting hook 24*a* to reduce the possibility of escape of the rods 28 during jostling of the container 14 in its handling by the lifting mechanism 12, particularly as it moves horizontally from its partially inverted position.

Each safety catch device 32 is comprised of catch member 34 pivotally attached alongside a lifting hook 24*a* by means of a bolt 36, nut 38 and washers 40 to allow free swinging of the catch member 32 between an up unrestricting position and a down restricting position.

These positions are established by a cutout forming a complementary catch hook 42, which is aligned with the associated lifting hook 24*a* when the catch member 34 is elevated so as to afford an unrestricted opening to the lifting hook 24*a*, as shown in FIG. 5.

In the lowered, restrictive position, the catch hook 24 moves into the space defining the opening of the lifting hook 24*a* to greatly narrow that gap, as indicated in FIG. 4.

An actuator piece 44 is also integral with the catch member 32 and extends in a direction across hook 42 but spaced away to define a gap therebetween. A stop block 46 is fixed to the free end of the actuator piece 44, which stop block 46 engages the lower edge 48 beneath the hook 24*a*, to locate the same in the lower restrictive position, which it normally assumes under the influence of gravity.

The safety catch mechanisms 32 have been found to operate to impede and restrict the escape of the rods 28 as a result of random jostling movements as the container 14 is transported by the lifting mechanism 12, so that the incidence of accidental dislodging is greatly reduced. This result is though to be obtained since the catch member 34 is moved to the restricting positoin upon any unseating movement of the rods 28, as the inside of the actuator piece 44 is contacted to rotate the catch member 34 down. In this position, the opening gap of the lifting hook 24*a* is greatly reduced, and impacting of the rod 28 from the inside of the catch hook 42 is resisted inasmuch as this results only in shear loading of the bolt 36. At the same time, the catch member 34 is pivoted out of the way of the rod 28 as the rod 28 contacts the same from the outside during engagement maneuvering, so that the catch member 34 will not restrict or interfere with obtaining proper seating of the rods 28 in the lifting hooks 24.

Since disengaging movement is straight down, the reduced width gap of the lifting hooks 24 does not present any difficulty in disengaging the same particulary since a ramping effect is obtained on the top of the actuator piece 44, facilitating movement of the bars 28 out of the lifting hooks 24*a*.

The design is simple, and rugged and is self acting, i.e., not requiring any intervention by the operator, so that the above object of the present invention has been achieved.

We claim:

1. In a system for handling containers by a truck mounted lifting mechanism including rods adapted to be elevated to engage lifting hooks comprised of hook contours formed in plates attached to either side of the container, each of said hook contours including a gap through which a rod may enter, the improvement comprising a safety catch mechanism associated with each of said lifting hooks, each of said safety catch mechanisms comprising a catch member and a pivotal mount therefor adjacent a respective lifting hook, said catch member formed with a contour shaped correspondingly to said lifting hook contour with a gap thorugh which a rod may enter, said catch member movable to align said adjacent lifting hook contour with said catch member hook contour upon moving to a raised pivotal position by elevation of a respective rod engaging said lifting hook and catch member hook contours; said pivotal mount and each catch member contour located so that whenever said each catch hook pivots down, said catch member contour moves out of alignment with an adjacent lifting hook contour and substantially into the opening gap of a respective adjacent lifting hook contour; an actuator piece fixed to said catch member extending across said catch member hook contour to define a reduced width gap therebetween, said actuator piece positioned to be engaged by said rod as said rod descends to move said catch member down and across said gap of said lifting hook contour and thereby impede the escape of said rod therefrom, whereby reducing the incidence of inadvertent escape of said rods from said lifting hooks.

2. The system according to claim 1 wherein a pair of vertically spaced lifting hooks are provided on said container, and a safety catch mechanism is associated with each upper lifting hook.

3. The system according to claim 2 wherein each safety catch mechanism comprises a plate cut out to integrally form said catch hook and actuator piece.

4. The system according to claim 1 wherein said actuator piece includes a stop block locating said catch piece in the lowered position by engagement with said plate.

* * * * *